US011474480B2

(12) United States Patent
Hattori et al.

(10) Patent No.: US 11,474,480 B2
(45) Date of Patent: Oct. 18, 2022

(54) TIMEPIECE

(71) Applicant: Seiko Instruments Inc., Chiba (JP)

(72) Inventors: Ryo Hattori, Chiba (JP); Yasunori Hara, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 848 days.

(21) Appl. No.: 16/359,321

(22) Filed: Mar. 20, 2019

(65) Prior Publication Data

US 2019/0294111 A1 Sep. 26, 2019

(30) Foreign Application Priority Data

Mar. 20, 2018 (JP) ..... JP2018-052936

(51) Int. Cl.
*G04B 19/14* (2006.01)

(52) U.S. Cl.
CPC ..... *G04B 19/14* (2013.01)

(58) Field of Classification Search
CPC ..... G04B 19/14
See application file for complete search history.

(56) References Cited

U.S. PATENT DOCUMENTS 4,207,735 A * 6/1980 Ishigaki ..... G04B 19/14 368/300
11,119,447 B2 * 9/2021 Balmer ..... G04C 3/14
2014/0016446 A1 * 1/2014 Correa ..... G04B 19/14 368/232
2014/0169143 A1 * 6/2014 Kobayashi ..... G04G 17/02 29/407.09
2018/0259910 A1 * 9/2018 Iguchi ..... G04D 1/0042

FOREIGN PATENT DOCUMENTS

GB 2079497 A * 1/1982 ..... G04B 19/14
JP 2001-194470 A 7/2001

* cited by examiner

*Primary Examiner* — Edwin A. Leon
*Assistant Examiner* — Jason M Collins
(74) *Attorney, Agent, or Firm* — Crowell & Moring LLP

(57) ABSTRACT

A timepiece includes a display plate, a movement which rotatably supports the display plate about an axis in a plate thickness direction and is installed in an axial direction, a straight pin which is erected in the movement in the axial direction, an opening portion which is provided in the display plate, into which the straight pin is inserted, and which includes a width decreasing portion having a width decreasing toward one side of the axis in a circumferential direction, and a rotation mechanism which rotates the display plate to the other side in the circumferential direction to cause the straight pin to be clamped by the width decreasing portion.

12 Claims, 16 Drawing Sheets

TIMEPIECE

RELATED APPLICATIONS

This application claims priority under 35 U.S.C. § 119 to Japanese Patent Application No. 2018-052936 filed on Mar. 20, 2018, the entire content of which is hereby incorporated by reference.

BACKGROUND OF THE INVENTION

1. Field of the Invention

The present disclosure relates to a timepiece having a plate member.

2. Description of the Related Art

In JP-A-2001-194470 (Patent Reference 1), a fixing structure of a display plate, in which a notch is provided in an outer peripheral portion of the display plate which is an example of a plate member of a timepiece, and the notch is engaged with a cylindrical protrusion provided in an auxiliary ring, is disclosed. In the timepiece disclosed in Patent Reference 1, lateral displacement and rotation of the display plate are prevented by elastically deforming the cylindrical protrusion to engage with the notch.

However, when fixing the display plate, it is necessary to push the cylindrical protrusion by elastically deforming the cylindrical protrusion toward the notch of the display plate, and if the cylindrical protrusion is short, elasticity is insufficient, it becomes difficult to push the cylindrical protrusion toward the notch, and mounting workability of the display plate deteriorates. On the other hand, if a length of the cylindrical protrusion is secured to improve the workability, a thickness of an entire timepiece increases and an appearance of the timepiece is impaired.

SUMMARY OF THE INVENTION

In view of above facts, each of embodiments of the invention provides a timepiece capable of easily attaching a plate member while maintaining a positioning accuracy of the plate member.

A timepiece described in claim 1 includes a plate member; an installation portion which rotatably supports the plate member about an axis in a plate thickness direction and is installed in an axial direction; a pin which is erected in the installation portion in the axial direction; an opening portion which is provided in the plate member, into which the pin is inserted, and which includes a width decreasing portion having a width decreasing toward one side of the axis in a circumferential direction; and a rotation mechanism which rotates the plate member to the other side in the circumferential direction to cause the pin to be clamped by the width decreasing portion.

The invention described in claim 2 provides the timepiece according to claim 1, in which the rotation mechanism includes a taper pin which is erected in the installation portion in the axial direction and has a diameter decreasing toward a tip, and a wall portion which is provided in the plate member and with which a peripheral surface of the taper pin on the other side in the circumferential direction comes into contact when the pin is inserted into the opening portion.

The invention described in claim 3 provides the timepiece according to claim 2, in which the taper pin is detachable from the installation portion.

The invention described in claim 4 provides the timepiece according to claim 1, in which the rotation mechanism includes an eccentric pin which is erected in the installation portion in the axial direction, and a wall portion which is provided in the plate member and with which an outer peripheral surface of the eccentric pin is capable of coming into contact, and in which a rotation range of the eccentric pin includes a first rotation range spaced apart from the wall portion, and a second rotation range being in contact with the wall portion.

The invention described in claim 5 provides the timepiece according to claim 1, in which the rotation mechanism includes a mounting member which is mounted on an upper surface of the plate member and includes a taper pin having a diameter decreasing toward the installation portion, an engagement hole which is provided in the installation portion and with which the taper pin is engaged, and a wall portion which is provided in the plate member, and with which a peripheral surface of the taper pin on the other side in the circumferential direction comes into contact when the pin is inserted into the opening portion, and the taper pin is inserted into the engagement hole.

The invention described in claim 6 provides the timepiece according to any one of claims 2 to 5, in which the wall portion is an inner peripheral surface of an opening formed in the plate member.

The invention described in claim 7 provides the timepiece according to any one of claims 2 to 5, in which the wall portion is a surface extending in a direction intersecting the circumferential direction of a notch formed on an outer periphery of the plate member.

Figure 9A:
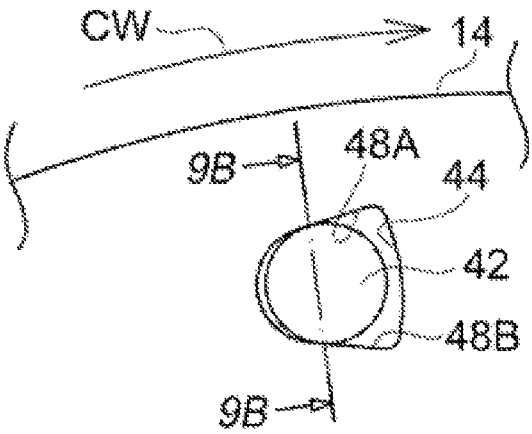
FIG. 9A is a front view illustrating a state where the straight pin bites the pin insertion opening portion and FIG.

9B is a sectional view that is taken along line 9B-9B of the display plate and the straight pin illustrated in FIG. 9A.

Figure 10A:
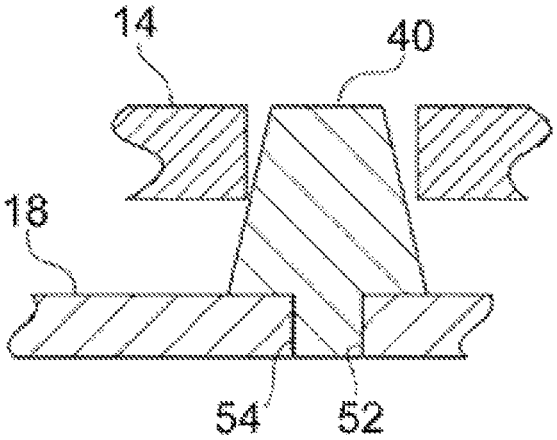
Figure 10B:
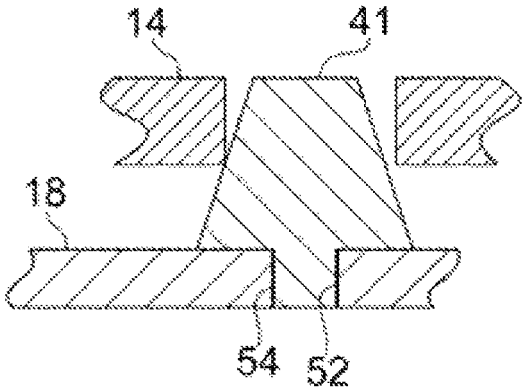

FIGS. 10A and 10B are sectional views illustrating a taper pin according to a second embodiment.

Figure 11A:
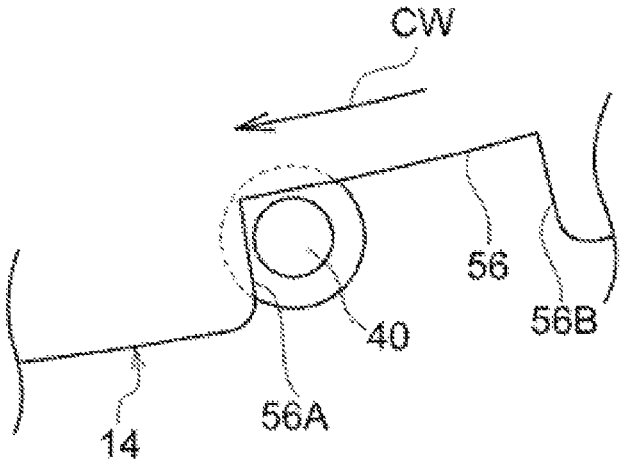
Figure 11B:
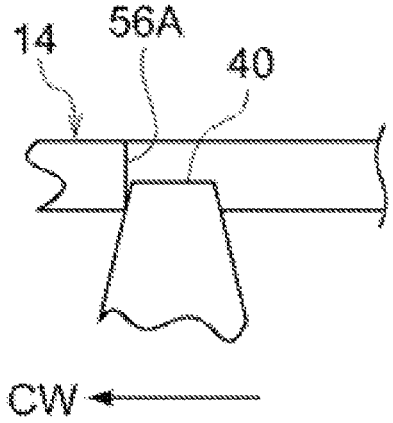

FIG. 11A is a front view illustrating a display plate and a taper pin of a timepiece according to a third embodiment and a middle of attachment of the display plate and FIG. 11B is a side view of the display plate and the taper pin illustrated in FIG. 11A.

Figure 12A:
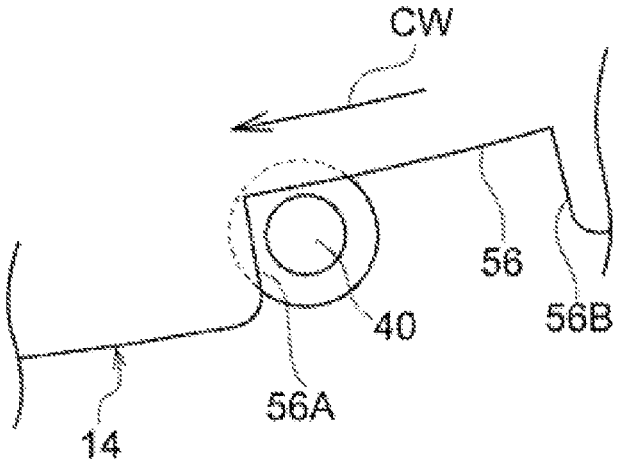
Figure 12B:
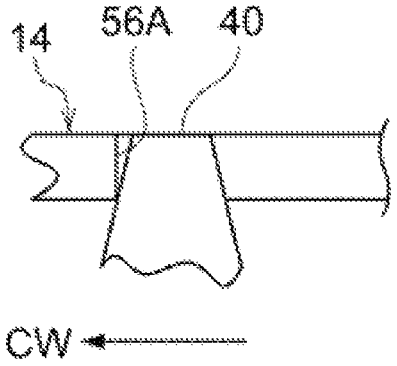

FIG. 12A is a front view illustrating the display plate and the taper pin of the timepiece according to the third embodiment and a state where attachment of the display plate is completed and FIG. 12B is a side view of the display plate and the taper pin illustrated in FIG. 12A.

Figure 13A:
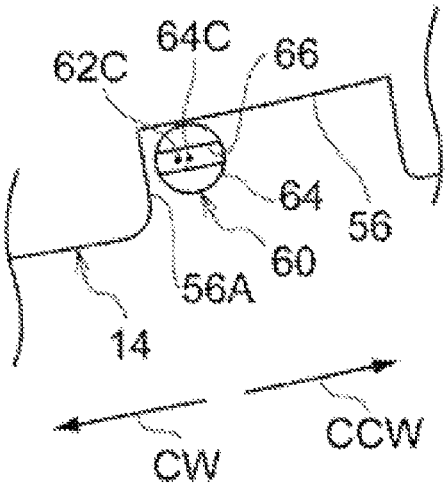
Figure 13B:
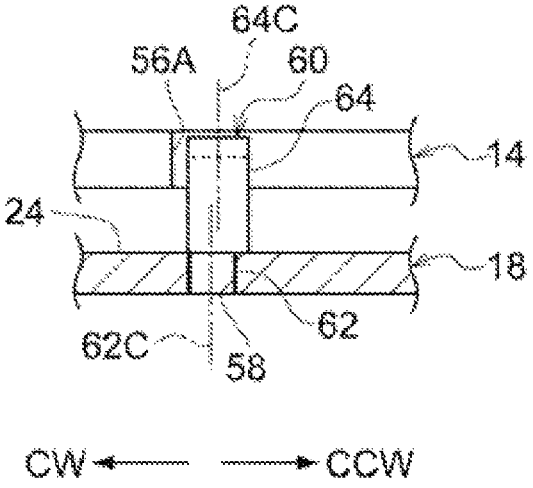

FIG. 13A is a front view illustrating a display plate and an eccentric pin of a timepiece according to a fourth embodiment and a state before the display plate is fixed and FIG. 13B is a side view of the display plate and the eccentric pin illustrated in FIG. 13A.

Figure 14A:
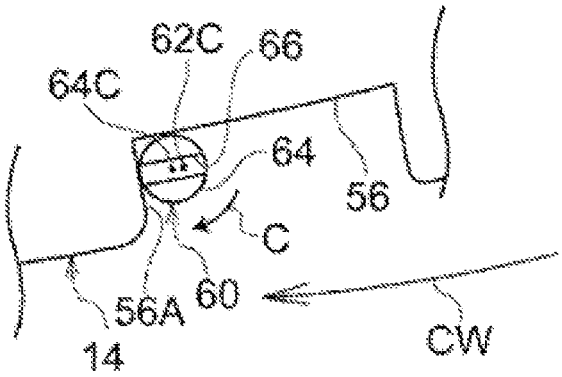
Figure 14B:
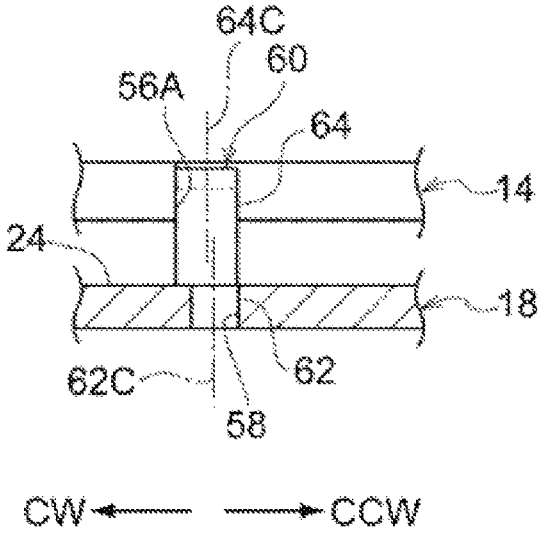

FIG. 14A is a front view illustrating the display plate and the eccentric pin of the timepiece according to the fourth embodiment and a state where the display plate is fixed and FIG. 14B is a side view of the display plate and the eccentric pin illustrated in FIG. 14A.

Figure 15A:
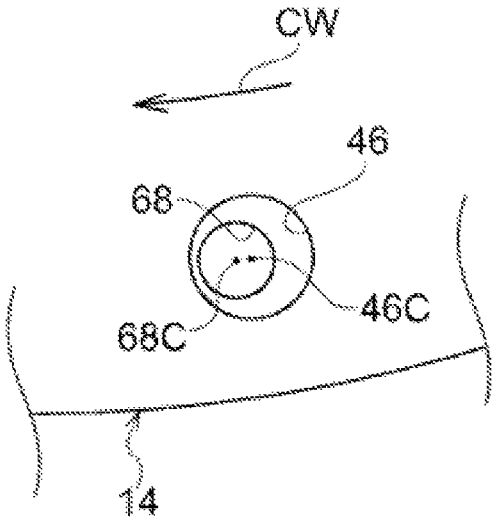
Figure 15B:
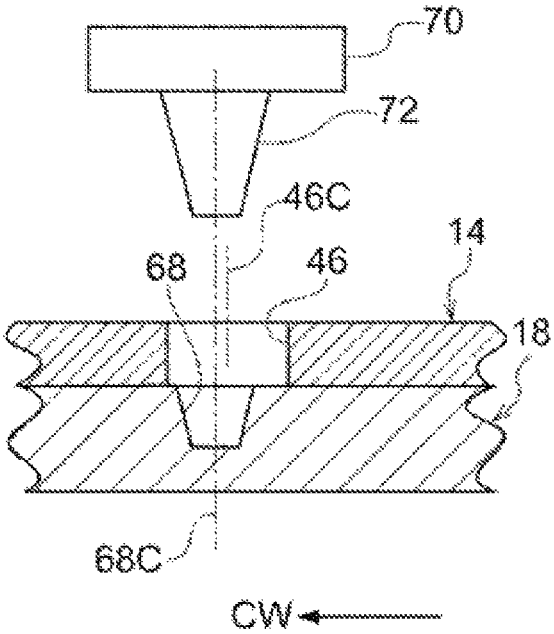

FIG. 15A is a front view illustrating a display plate and a movement of a timepiece according to a fifth embodiment and a state before the display plate is attached and FIG. 15B is a side view of the display plate and the movement illustrated in FIG. 15A.

Figure 16A:
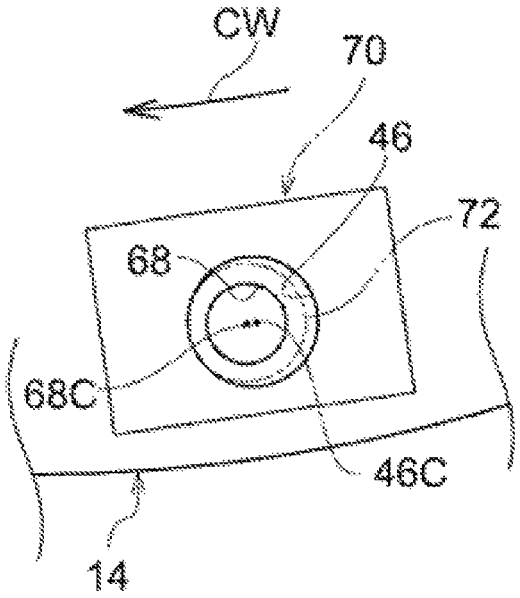
Figure 16B:
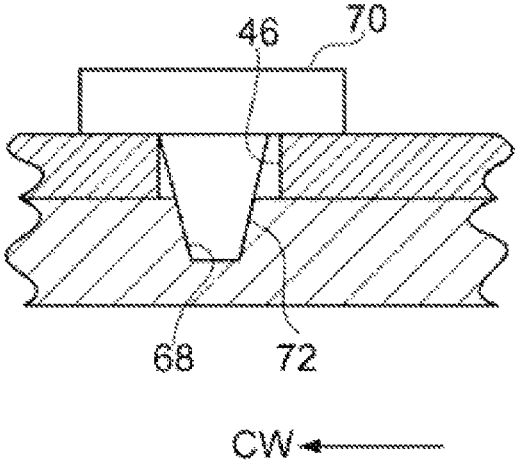

FIG. 16A is a front view illustrating the display plate, a planting matter and the movement of a timepiece according to the fifth embodiment and a state where the display plate is attached and FIG. 16B is a side view of the display plate, the planting matter, and the movement illustrated in FIG. 16A.

DETAILED DESCRIPTION OF THE PREFERRED EMBODIMENTS

First Embodiment

Figure 1:
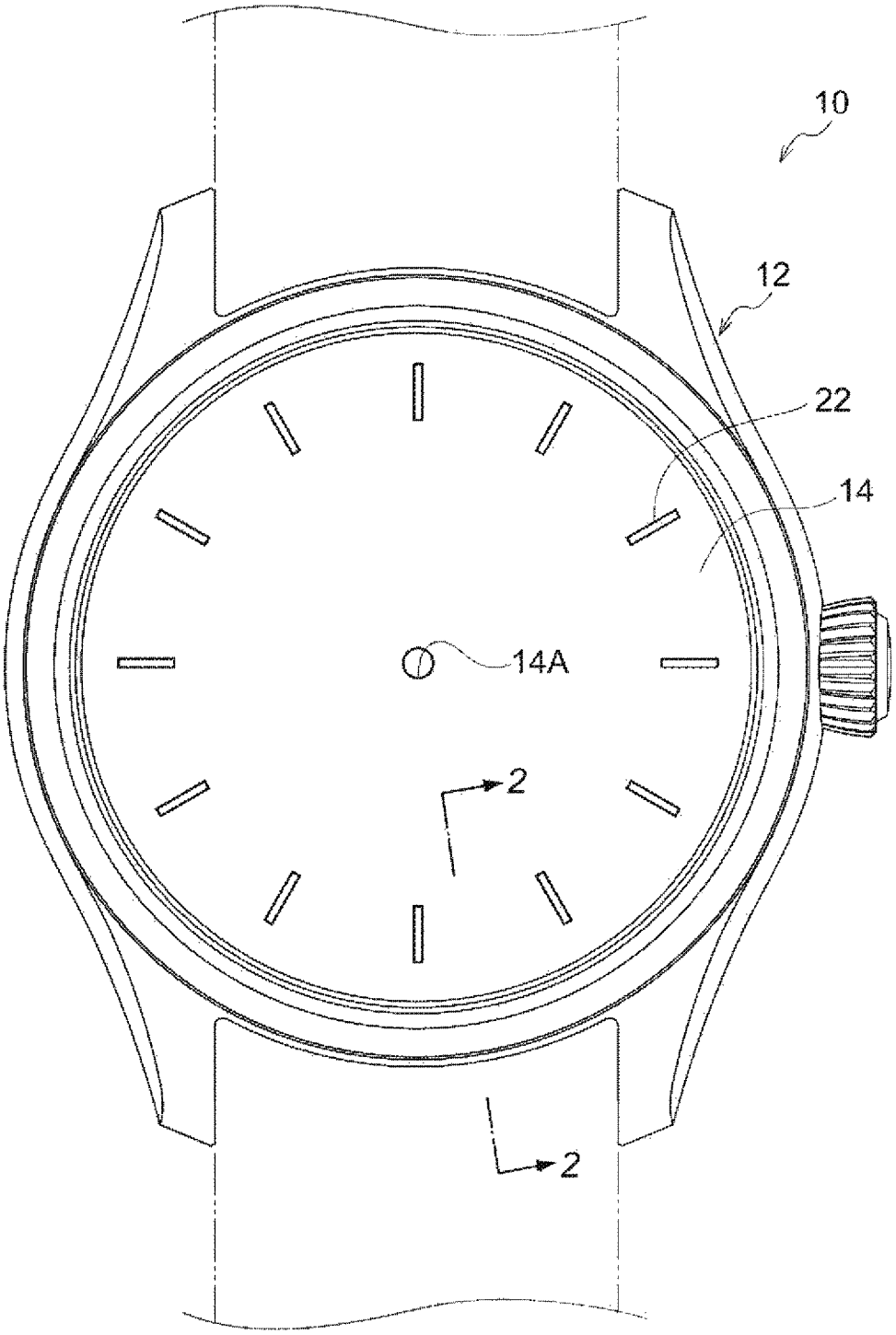
FIG. 1 is a front view illustrating a timepiece according to a first embodiment of the invention.
Figure 2A:
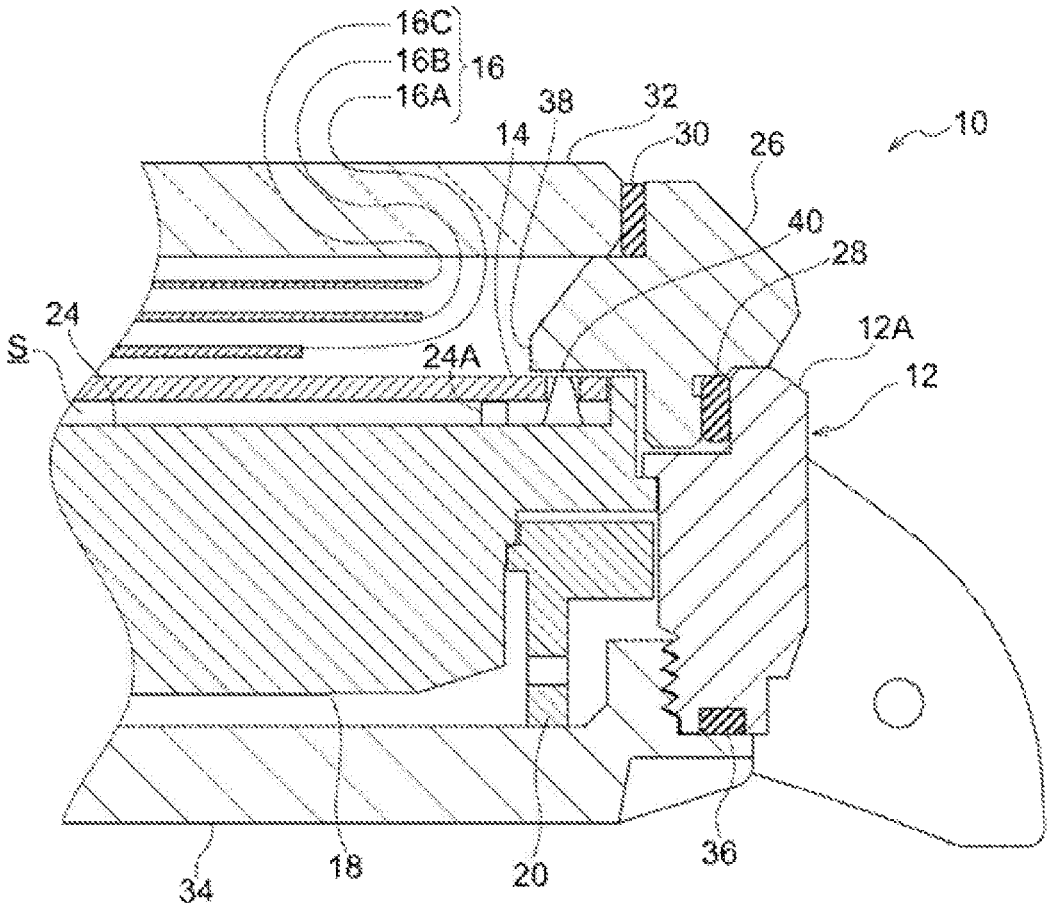
FIG. 2A is a sectional view that is taken along line 2-2 of the timepiece illustrated in FIG. 1

A first embodiment of the invention will be described with reference to FIGS. 1 to 9. As illustrated in FIGS. 1 and 2A, a wristwatch 10 includes a case 12 forming an exterior.

A circular display plate 14, a movement 18 for controlling a movement of a time display hand 16 (not illustrated in FIG. 1) indicating a time, and the like are housed in the case 12. The movement 18 is housed inside the case 12 together with a middle frame 20. The display plate 14 is an example of a plate member of the invention and the movement 18 is an example of an installation portion of the invention.

The movement 18 may be of a type in which the time display hand 16 is driven by a driving force of a motor, or may be a type in which the time display hand 16 is driven by a driving force of a power spring.

As a material constituting the display plate 14, metal, synthetic resin, glass, ceramics, or the like can be used as an example, and it is not particularly limited, and conventionally known materials can be used. The display plate 14 may be provided with, for example, a solar panel for obtaining power for driving the motor, or may be provided with a liquid crystal display plate, an EL light emitting plate, or the like.

Figure 2B:
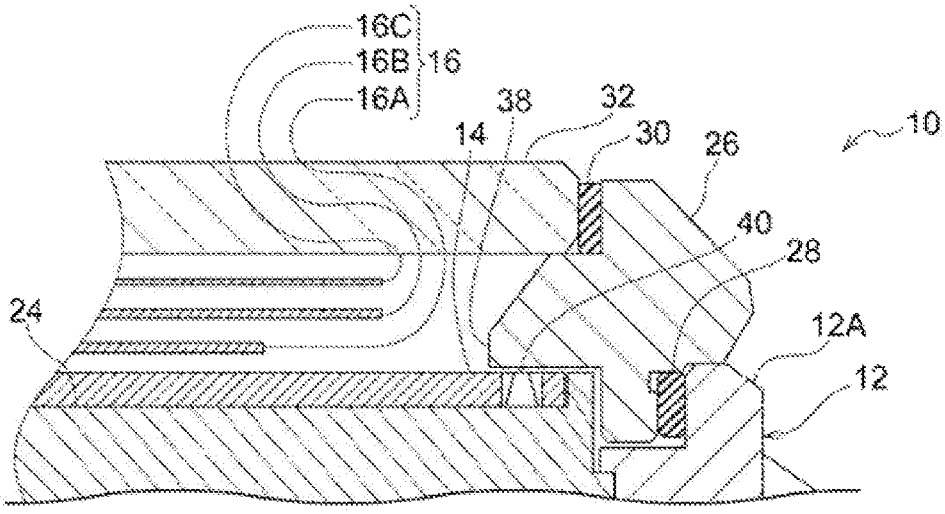
FIG. 2B is a sectional view of a timepiece according to a modification example.
Figure 3:
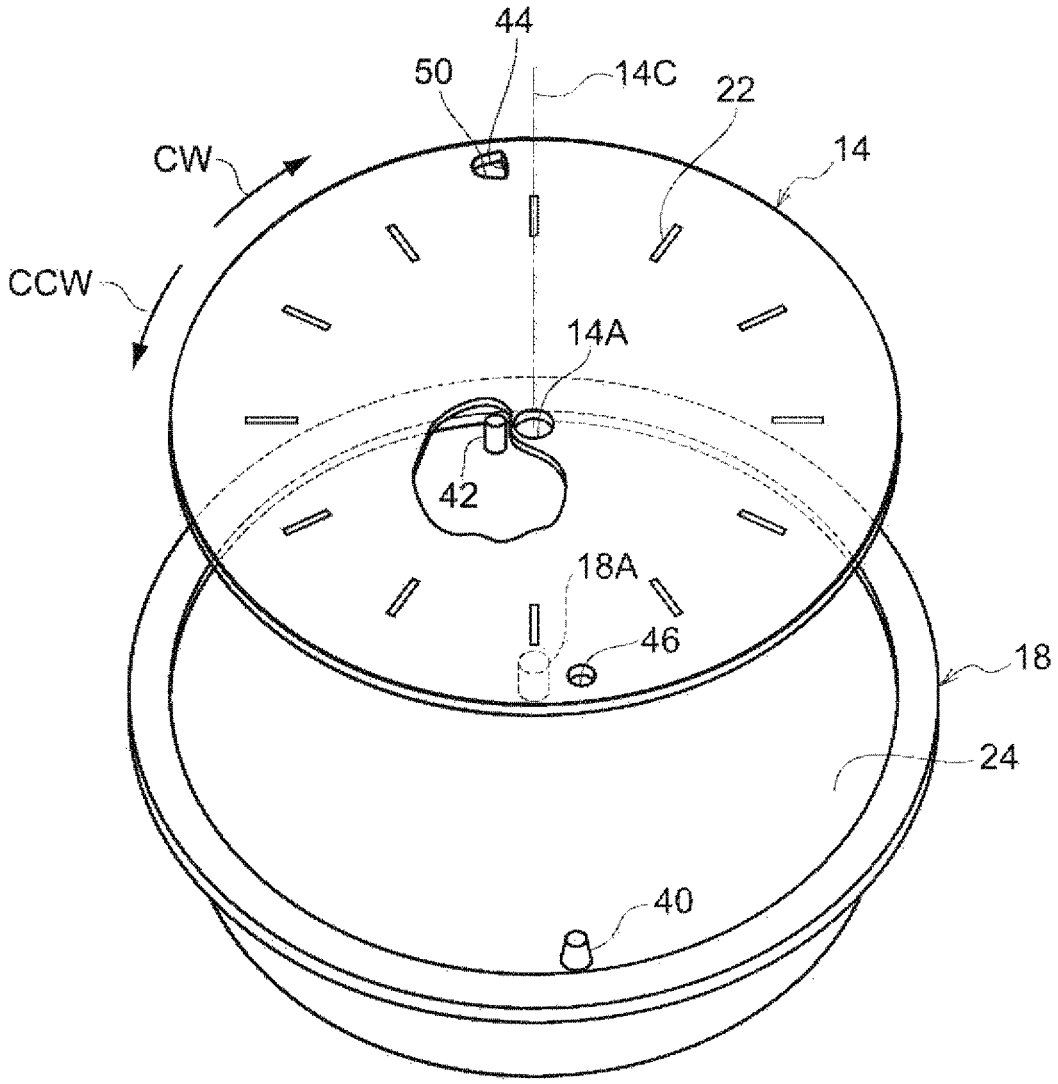
FIG. 3 is an exploded perspective view illustrating a display plate and a movement.
Figure 4A:
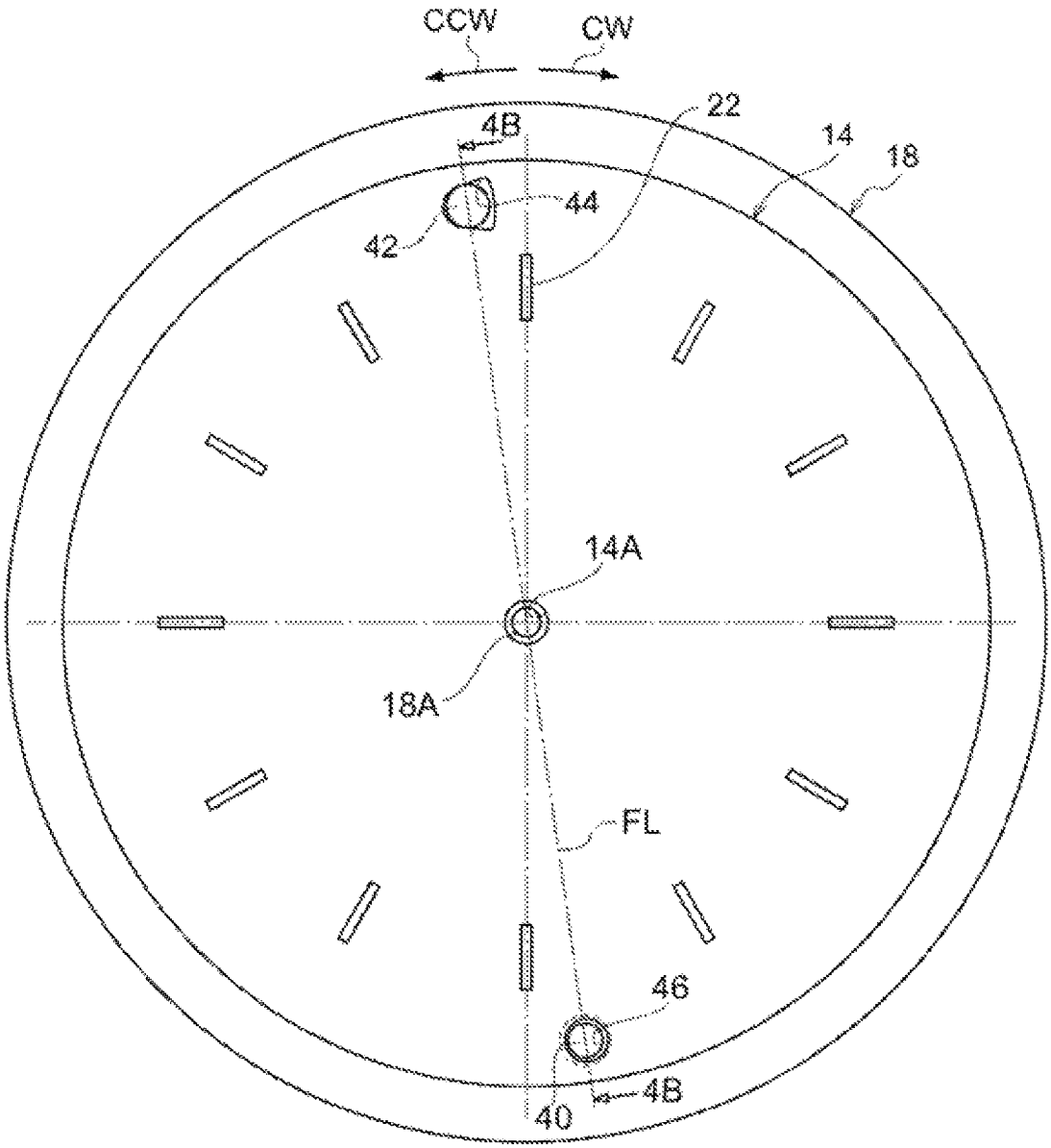
FIG. 4A is a front view illustrating the display plate attached to the movement and FIG. 4B is a sectional view that is taken along line 4B-4B of the display plate illustrated in FIG. 4A.
Figure 4B:
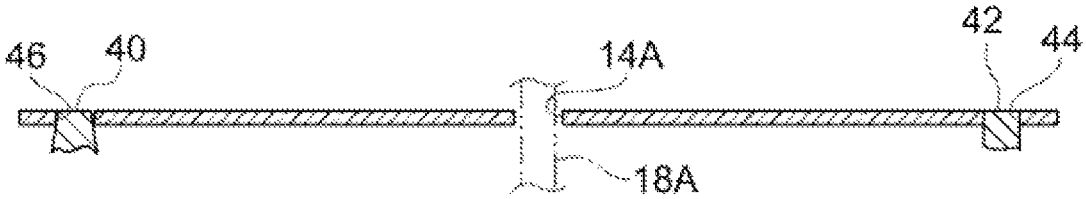

As illustrated in FIGS. 3 and 4, a hand shaft 18A for attaching the time display hand 16 illustrated in FIG. 2 protrudes at a center portion on a surface side of the movement 18. As illustrated in FIG. 2A, the time display hand 16 of the embodiment is constituted to include an hour hand 16A, a minute hand 16B, and a second hand 16C. As illustrated in FIG. 4A, a hand shaft insertion hole 14A into which the hand shaft 18A is inserted is formed at the center portion and time display indicators 22 are provided at a peripheral portion in the display plate 14. An inner diameter of the hand shaft insertion hole 14A is greater than an outer diameter of the hand shaft 18A so that the hand shaft 18A is not in contact with the hand shaft insertion hole 14A.

As illustrated in FIGS. 2A and 3, a recessed portion 24 having a circular shape in a plan view for fitting the display plate 14 is formed on a timepiece surface side of the movement 18. An inner diameter of the recessed portion 24 is slightly greater than an outer diameter of the display plate 14 and the movement of the display plate 14 in a radial direction is restricted inside the recessed portion 24, but slight rotation is possible.

As illustrated in FIG. 2A, the case 12 is configured such that an annular glass edge 26 is liquid-tightly installed on a surface side in a thickness direction of a body 12A formed in an annular shape via an annular glass edge fixing packing 28. A circular glass 32 as a see-through cover is liquid-tightly installed on an inner periphery side of the glass edge 26 via an annular glass fixing packing 30. The display plate 14 and the time display hand 16 can be seen through the glass 32.

In addition, a case back 34 is installed on a back surface side of the body 12A in the thickness direction. The case back 34 of the embodiment is a so-called screw back and an annular case back packing 36 is provided between the case 12 and the case back 34.

An annular projection portion 38 protruding toward an inside in a radial direction is formed at a center portion in the thickness direction in the inner peripheral portion of the glass edge 26. The annular projection portion 38 covers the outer peripheral portion of the display plate 14 from the timepiece surface side so that the display plate 14 does not come off from the recessed portion 24 of the movement 18.

Moreover, in FIG. 2A, a gap S (here, substantially the same dimension as a thickness dimension of the display plate 14) is provided between the back surface of the display plate 14 and a bottom portion of the recessed portion 24, but as illustrated in FIG. 2B, a gap may not be formed between the back surface of the display plate 14 and the bottom portion of the recessed portion 24. As illustrated in FIG. 2A, in a case where the gap S is provided between the back surface of the display plate 14 and the bottom portion of the recessed portion 24, for example, it is preferable that a protrusion 24A supporting the display plate 14 from a back surface side is provided in the recessed portion 24.

(Holding Mechanism of Display Plate)

As described below, in the wristwatch 10 of the embodiment, the display plate 14 is supported so as not to rattle in the rotation direction with respect to the movement 18.

As illustrated in FIG. 3, a taper pin 40 is attached to one side (substantially 6 o'clock direction side) and a straight pin 42 is attached to the other side (substantially 12 o'clock direction side) in the radial direction on the bottom surface of the recessed portion 24 of the movement 18 with the hand shaft 18A interposed therebetween. The taper pin 40 has a circular cross section perpendicular to the axial direction and has a truncated cone shape in which a diameter gradually decreases toward the tip. On the other hand, the straight pin 42 has a circular cross section perpendicular to the axial direction and has a constant diameter over an entire length.

Figure 5:
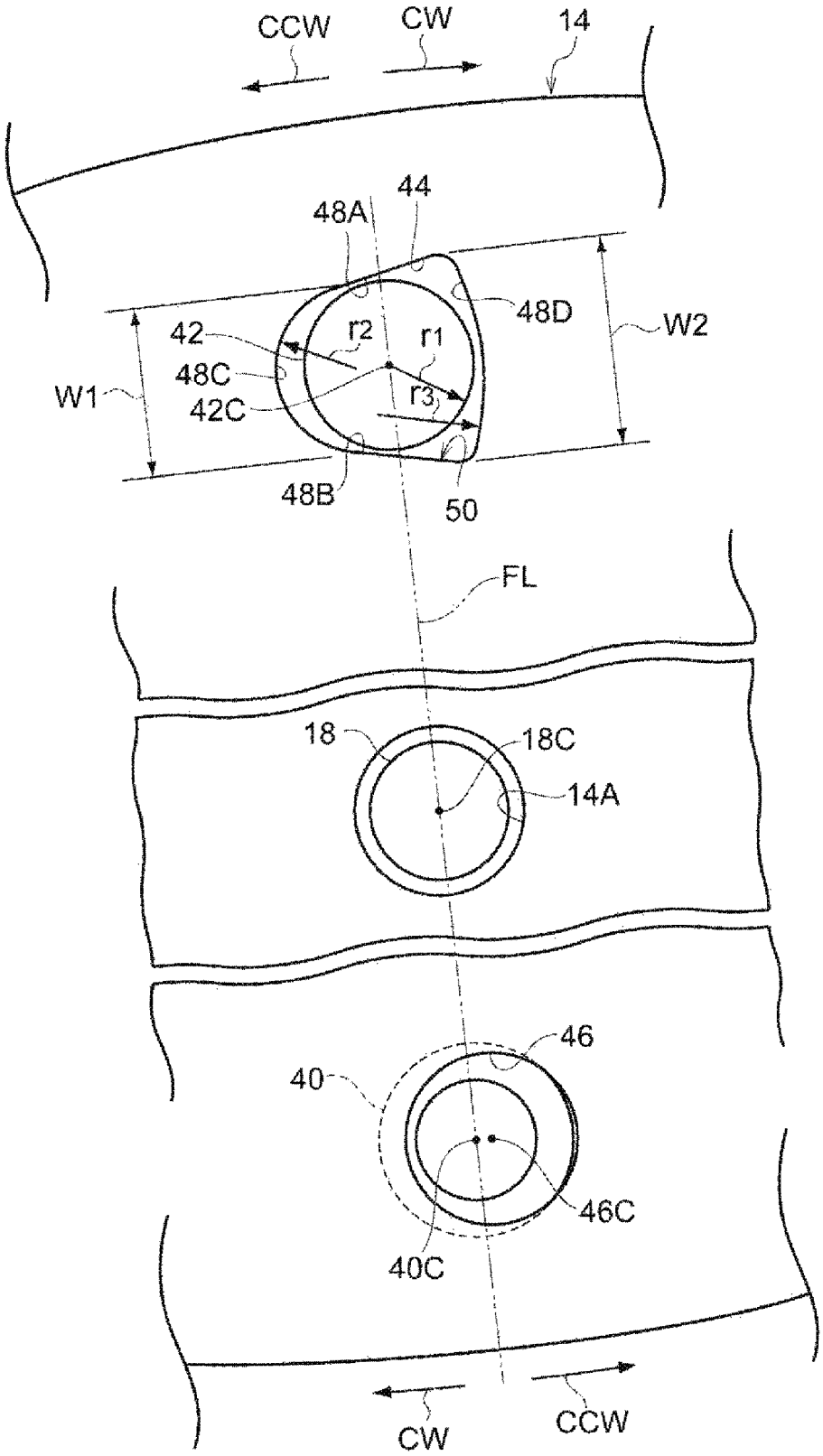
FIG. 5 is an enlarged front view of a part of the display plate.

As illustrated in FIGS. 4 and 5, a central axis 40C of the taper pin 40, a central axis 18C of the hand shaft 18A and a central axis 42C of the straight pin 42 are disposed (disposed on an imaginary line FL of FIG. 4) to be aligned in a straight line in a plan view of the movement 18.

An opening portion 44 into which the straight pin 42 is inserted is formed on one side (substantially 12 o'clock direction side) and a round hole 46 into which the taper pin 40 is inserted is formed on the other side (substantially 6 o'clock direction side) in the radial direction in the display plate 14 with the hand shaft insertion hole 14A interposed therebetween. Moreover, the taper pin 40 and the round hole 46 are examples of a rotation mechanism of the invention.

As illustrated in FIG. 5, the opening portion 44 has a tapered shape of which a width dimension gradually decreases in the counterclockwise direction (arrow CCW direction), and includes an outer inclined surface 48A positioned on an outside of the display plate 14 in the radial direction, an inner inclined surface 48B positioned on an inside of the display plate 14 in the radial direction, a small circular arc portion 48C positioned in the counterclockwise direction (arrow CCW direction) of the display plate 14, and a large circular arc portion 48D positioned in the clockwise direction (arrow CW direction) of the display plate 14. Moreover, a width decreasing portion 50 of the embodiment is constituted of the outer inclined surface 48A and the inner inclined surface 48B.

In the embodiment, a radius of curvature r2 of the small circular arc portion 48C is smaller than a radius of curvature r1 (half of the outer diameter) of the straight pin 42, and a radius of curvature of the large circular arc portion 48D is greater than the radius of curvature r1 of the straight pin 42. In addition, a gap dimension W1 between the outer inclined surface 48A and the inner inclined surface 48B in the counterclockwise direction side (arrow CCW direction side) is smaller than a diameter dimension of the straight pin 42 and a gap dimension W2 between the outer inclined surface 48A and the inner inclined surface 48B in the clockwise direction side (arrow CW direction side) is greater than a diameter dimension of the straight pin 42.

The opening portion 44 is formed in a size such that the outer peripheral surface of the straight pin 42 does not come into contact with the inner peripheral surface (the outer inclined surface 48A, the inner inclined surface 48B, the small circular arc portion 48C, and the large circular arc portion 48D) of the opening portion 44 when inserting the straight pin 42. In addition, the opening portion 44 has a size to be set such that the outer peripheral surface of the straight pin 42 comes into contact with an intermediate portion of the outer inclined surface 48A in the longitudinal direction and an intermediate portion of the inner inclined surface 48B in the longitudinal direction, and does not come into contact with the small circular arc portion 48C when the straight pin 42 is rotated in the counterclockwise direction (arrow CCW direction) in a state where the straight pin 42 is inserted.

(Procedure for Attaching Display Plate)

Hereinafter, a procedure for attaching the display plate 14 to the movement 18 will be described.

Figure 6A:
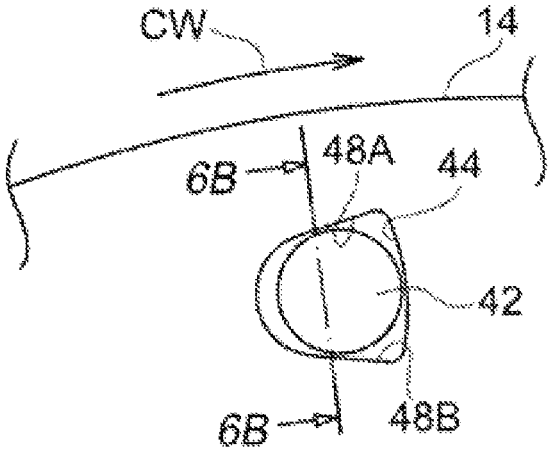
FIG. 6A is a front view illustrating a state where a tip of a straight pin is inserted into a pin insertion opening portion and FIG. 6B is a sectional view that is taken along line 6B-6B of the display plate and the straight pin illustrated in FIG. 6A.
Figure 6B:
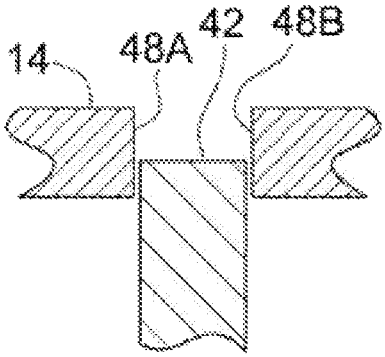

(1) First, after the display plate 14 is disposed at an approximate position above the movement 18, the display plate 14 is inclined so that the opening portion 44 side is slightly lowered, and as illustrated in FIG. 6, the tip of the straight pin 42 is inserted into the opening portion 44 of the display plate 14.

Figure 7A:
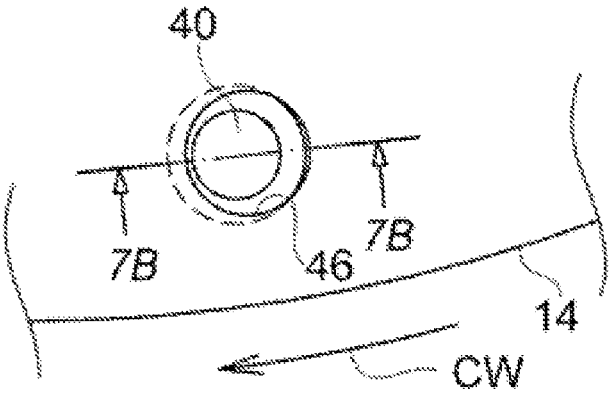
FIG. 7A is a front view illustrating a state where a tip of a taper pin is inserted into a hole and FIG. 7B is a sectional view that is taken along line 7B-7B of the display plate and the straight pin illustrated in FIG. 7A.
Figure 7B:
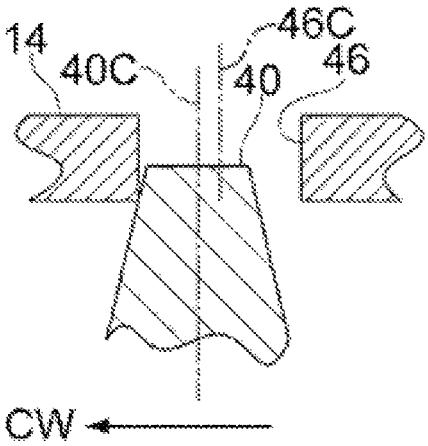

(2) Next, the round hole 46 side of the display plate 14 is lowered and as illustrated in FIG. 7, the tip of the taper pin 40 is inserted into the round hole 46. Since a central axis 46C of the round hole 46 and the central axis 40C of the taper pin 40 are shifted in the circumferential direction, an inner peripheral end portion of the round hole 46 comes into contact with an inclined surface of the taper pin 40 in the clockwise direction side (CW direction side).

Figure 8A:
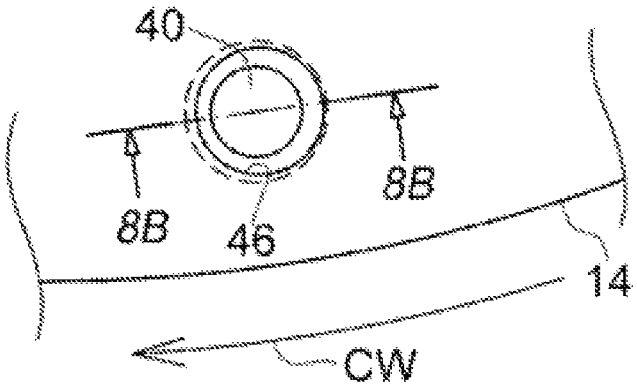
FIG. 8A is a front view illustrating a state where the display plate is pushed to a recessed portion by inserting the taper pin into the hole and FIG. 8B is a sectional view that is taken along line 8B-8B of the display plate and the straight pin illustrated in FIG. 8A.
Figure 8B:
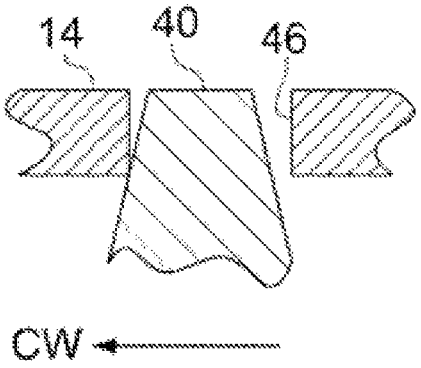

(3) Next, when the display plate 14 is further pushed to the recessed portion 24 of the movement 18, as illustrated in FIG. 8, the inner peripheral end portion of the round hole 46 causes the inclined surface of the taper pin 40 to slide toward a base portion and the display plate 14 rotates in the clockwise direction (arrow CW direction).

Figure 9B:
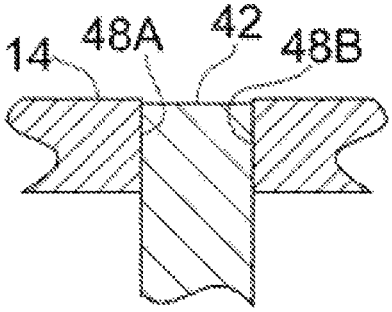

(4) When the display plate 14 rotates in the clockwise direction (arrow CW direction), as illustrated in FIG. 9, the opening portion 44 relatively moves in the clockwise direction with respect to the straight pin 42, the straight pin 42 bites the width decreasing portion 50, and positioning and fixing of the display plate 14 in the rotation direction are performed.

(5) Next, the movement 18 to which the display plate 14 is attached is positioned at a predetermined position inside the case 12, and the glass edge 26 is attached to the case 12. Therefore, as illustrated in FIG. 2A, the display plate 14 is in a state of being interposed between the annular projection portion 38 of the glass edge 26 and the recessed portion 24 of the movement 18, and is supported so as not to rattle in the thickness direction of the wristwatch 10.

In the embodiment, as described above, the display plate 14 can be attached to the movement 18 in a correct orientation with a high degree of accuracy with a simple operation of pushing the display plate 14 to the recessed portion 24 of the movement 18. Therefore, this makes it possible to suppress that the hour hand 16A, the minute hand 16B, and the second hand 16C are shifted with respect to the time display indicator 22 of the display plate 14.

In addition, since it is not necessary to elastically deform the taper pin 40 and the straight pin 42 when the display plate 14 is attached to the movement 18, a large force does not act on the display plate 14 from the taper pin 40 and the straight pin 42 and deformation of the display plate 14 is suppressed. Therefore, it is possible to form the display plate 14 to be thin and it is also possible to reduce the thickness of the wristwatch 10.

Furthermore, since the taper pin 40 and the straight pin 42 need to have only lengths enough to come into contact with the end portion of the display plate 14, it is not necessary to lengthen the taper pin 40 and the straight pin 42 so as to be easily elastically deformed. In other words, for example, as illustrated in FIG. 2B, the taper pin 40 and the straight pin 42 may have substantially the same length as a thickness dimension of the display plate 14, and the thickness dimension of the wristwatch 10 is not increased by influences of the taper pin 40 and the straight pin 42.

In the embodiment, the taper pin 40 and the round hole 46 are provided on substantially 6 o'clock direction side of the wristwatch 10, and the straight pin 42 and the opening portion 44 are provided on substantially 12 o'clock direction side of the wristwatch 10, but the invention is not limited thereto and the taper pin 40, the round hole 46, the straight pin 42, and the opening portion 44 may be provided at a position hidden by the glass edge 26, and may be provided at a portion other than the position illustrated in the embodiment.

Second Embodiment

A wristwatch 10 according to a second embodiment of the invention will be described with reference to FIG. 10.

Moreover, the same reference numerals are given to the same configurations as those of the first embodiment and the description will be omitted.

As illustrated in FIG. 10A, a hole 52 is formed in a movement 18 and a protrusion 54 capable of inserting into the hole 52 is formed at a base end portion of a taper pin 40 of the embodiment.

The protrusion 54 is inserted into the hole 52, so that the taper pin 40 and the movement 18 are fixed. In addition, as an example of a fixed state, the protrusion 54 is inserted and bonded to the hole 52, so that the taper pin 40 may be fixed to the movement 18. Since a plurality of taper pins 40 having different diameters can be used for one type of the movement 18 by configuring in this way, various types of the display plates 14 can be fixed to one type of the movement 18.

In addition, as another example of the fixed state, the taper pin 40 may be exchanged with respect to the movement 18 and, for example, an outer shape of the protrusion 54 and an inner shape of the hole 52 may be in a relationship of an intermediate fit or an interference fit (JIS B 0401 or the like), or the protrusion 54 and the hole 52 may be formed with threads engaging with each other.

In addition to the above-mentioned effects, it is also possible to exchange the taper pin 40 with another taper pin 41 having different diameter as illustrated in FIG. 10B by configuring in this way. Therefore, this makes it possible to perform fine adjustment (adjustment of a rotation amount of the display plate 14 in the circumferential direction) when fixing the display plate 14 and repair correspondence at the time of breakage.

Third Embodiment

A wristwatch 10 according to a third embodiment of the invention will be described with reference to FIGS. 11 and 12. Moreover, the same reference numerals are given to the same configurations as those of the first embodiment and the description will be omitted.

As illustrated in FIG. 11, in a display plate 14 of the embodiment, a notch 56 having a substantially rectangular shape is formed on an outer peripheral portion instead of the round hole 46 (see FIG. 5) of the first embodiment. The notch 56 is provided with wall portions 56A and 56B extending in the radial direction of the display plate 14.

In the embodiment, as illustrated in FIG. 6 of the first embodiment, when inserting the straight pin 42 so that the straight pin 42 does not come into contact with the width decreasing portion 50 of the opening portion 44, as illustrated in FIG. 11, a position of the notch 56 and a position of the taper pin 40 are determined so that an inclined surface of the taper pin 40 on a tip side comes into contact with the wall portion 56A of the notch 56 in the clockwise direction side (CW direction side).

(Fixing Method of Display Plate)

When the display plate 14 is pushed down from a state illustrated in FIG. 11, as illustrated in FIG. 12, the wall portion 56A of the notch 56 causes the inclined surface of the taper pin 40 to slide toward a base portion and the display plate 14 rotates in the clockwise direction side (CW direction side).

When the display plate 14 rotates in the clockwise direction side (CW direction side), as described in the first embodiment, the opening portion 44 relatively moves with respect to the straight pin 42 in the clockwise direction, the straight pin 42 bites the width decreasing portion 50, and positioning and fixing of the display plate 14 in the rotation direction are performed.

As described above, also in the wristwatch 10 of the embodiment, similar to the first embodiment, the display plate 14 is pushed down, so that positioning and fixing of the display plate 14 in the rotation direction are performed. In addition, similar to the first embodiment, since it is not necessary to elastically deform the taper pin 40 and the straight pin 42, deformation of the display plate 14 can be suppressed.

Fourth Embodiment

A wristwatch 10 according to a fourth embodiment of the invention will be described with reference to FIGS. 13 and 14. Moreover, the embodiment is a modification example of the third embodiment and the same reference numerals are given to the same configurations as those of the third embodiment and the description will be omitted.

As illustrated in FIG. 13, a round hole 58 is formed in a movement 18 and a first shaft 62 of an eccentric pin 60 is rotatably inserted into the round hole 58. In the eccentric pin 60, a second shaft 64 is integrally formed on one end side of the first shaft 62. A central axis 62C of the first shaft 62 and a central axis 64C of the second shaft 64 are displaced in the radial direction. In addition, a groove 66 into which a tip of a minus screwdriver is inserted is formed at a tip of the second shaft 64.

In the embodiment, in the display plate 14 of the embodiment, as illustrated in FIG. 6 of the first embodiment, when inserting the straight pin 42 so that the straight pin 42 does not come into contact with the width decreasing portion 50 of the opening portion 44, as illustrated in FIG. 13, the second shaft 64 is displaced in advance with respect to the first shaft 62 in the counterclockwise direction side (arrow CCW direction side) of the display plate 14, so that the second shaft 64 of the eccentric pin 60 does not come into contact with the wall portion 56A of the notch 56 in the clockwise direction side (CW direction side).

In order to rotate the display plate 14 in the clockwise direction (CW direction), the tip of the minus screwdriver may be inserted into the groove 66 formed in the second shaft 64 and the eccentric pin 60 may rotate, for example, in the clockwise direction (arrow C direction in FIG. 14A). Therefore, the second shaft 64 rotates in a state of being eccentric about the central axis 62C of the first shaft 62, so that a distance between the wall portion 56A and the second shaft 64 becomes relatively close, the wall portion 56A is pressed by a side surface of the second shaft 64, and thereby the display plate 14 rotates in the clockwise direction (arrow CW direction).

After the display plate 14 is inserted into a recessed portion 24 of the movement 18, the eccentric pin 60 is rotated in one direction, and as illustrated in FIG. 14, the wall portion 56A of the notch 56 is pushed by an outer peripheral surface of the second shaft 64 in the clockwise direction (arrow CW direction) to rotate the display plate 14 in the clockwise direction (arrow CW direction).

When the display plate 14 rotates in the clockwise direction (CW direction), as described in the first embodiment, the opening portion 44 relatively moves with respect to the straight pin 42 in the clockwise direction, the straight pin 42 bites the width decreasing portion 50, and fixing of the display plate 14 in the rotation direction is performed.

As described above, in the wristwatch 10 of the embodiment, positioning and fixing of the display plate 14 in the rotation direction can be simply performed only by rotating the eccentric pin 60 after the display plate 14 is inserted into the recessed portion 24. In addition, since it is not necessary to elastically deform the eccentric pin 60, deformation of the display plate 14 can be suppressed.

Moreover, a rotation range in which the second shaft 64 is separated from the wall portion 56A during one rotation of the eccentric pin 60 is a first rotation range of the invention, a rotation range in which the second shaft 64 comes into contact with the wall portion 56A is a second rotation range of the invention, and the display plate 14 can be rotated by having the second rotation range.

Fifth Embodiment

A wristwatch 10 according to a fifth embodiment of the invention will be described with reference to FIGS. 15 and 16. Moreover, the same reference numerals are given to the same configurations as those of the embodiments described above and the description will be omitted.

As illustrated in FIG. 15, an engagement hole 68 having a taper hole shape is formed in a movement 18, and as illustrated in FIG. 6, when inserting the straight pin 42 so that the straight pin 42 does not come into contact with the width decreasing portion 50 of the opening portion 44, as illustrated in FIG. 15, positions of the engagement hole 68 and the round hole 46 are determined, so that a center axis 68C of the engagement hole 68 of the movement 18 is displaced with respect to the center axis 46C of the round hole 46 of the display plate 14 in the clockwise direction side (CW direction side).

A tip side of a taper pin 72 of a planting matter 70 installed on the surface of the display plate 14 can be inserted into the engagement hole 68 of the movement 18 via the round hole 46 of the display plate 14. The planting matter 70 is an example of an installation member of the invention. As the planting matter 70, for example, a window frame, a time character, a mark, or the like can be cited.

(Fixing Method of Display Plate)

As illustrated in FIG. 16, when the taper pin 72 of the planting matter 70 is pushed into the engagement hole 68 of the movement 18 from a state illustrated in FIG. 15, in the process of pushing the taper pin 72, an inclined outer peripheral surface of the taper pin 72 in the clockwise direction side (CW direction side) slides on the round hole 46 of the display plate 14 to rotate the display plate 14 in the clockwise direction (CW direction).

When the display plate 14 rotates in the clockwise direction (CW direction), as described in the first embodiment, the opening portion 44 relatively rotates with respect to the straight pin 42 in the clockwise direction, the straight pin 42 bites the width decreasing portion 50, and positioning and fixing of the display plate 14 in the rotation direction are performed.

As described above, in the wristwatch 10 of the embodiment, positioning and fixing of the display plate 14 in the rotation direction can be simply performed only by pushing the taper pin 72 of the planting matter 70 into the engagement hole 68 of the movement 18 after the display plate 14 is inserted into the recessed portion 24. In addition, since it is not necessary to elastically deform the taper pin 72 of the planting matter 70, deformation of the display plate 14 can be suppressed.

Other Embodiments

Although the embodiments of the present invention have been described above, the present invention is not limited to the above, and it goes without saying that various modifications can be made without departing from the scope of the invention.

In the embodiments described above, as an example of the installation portion, the movement 18 is cited, but the installation portion may be other than the movement 18 as long as the display plate 14 is attached.

Although the movement of the display plate 14 of the embodiments described above in the radial direction is restricted by inserting the display plate 14 into the recessed portion 24, the present invention is not limited thereto, and for example, a round pipe passing through the hand shaft 18A is protruded at the center of the movement 18 and the round pipe is inserted into the hand shaft insertion hole 14A of the display plate 14 without gap, so that the movement of the display plate 14 in the radial direction can be restricted. According to such a configuration, it is not necessary to form the recessed portion 24 in the movement 18.

In the embodiments described above, an example in which the present invention is applied to the wristwatch is described. However, the present invention is not limited to the wristwatch, but can also be applied to a timepiece other than the wristwatch. In addition, the timepiece may be a portable device or the like which is not called the timepiece, regardless of its shape or form, as long as it can display the time.

What is claimed is:

1. A timepiece comprising:

a plate member;

an installation portion which rotatably supports the plate member about an axis in a plate thickness direction and is installed in an axial direction;

a pin which is erected in the installation portion in the axial direction;

an opening portion which is provided in the plate member, into which the pin is inserted, and which includes a width decreasing portion having a width decreasing toward one side of the axis in a circumferential direction; and a rotation mechanism which rotates the plate member to the other side in the circumferential direction to cause the pin to be clamped by the width decreasing portion, wherein the rotation mechanism includes a taper pin which is erected in the installation portion in the axial direction and has a diameter decreasing toward a tip, and a wall portion which is provided in the plate member and with which a peripheral surface of the taper pin on the other side in the circumferential direction comes into contact when the pin is inserted into the opening portion.

2. The timepiece according to claim 1, wherein the taper pin is detachable from the installation portion.

3. The timepiece according to claim 2, wherein the wall portion is an inner peripheral surface of an opening formed in the plate member.

4. The timepiece according to claim 2, wherein the wall portion is a surface extending in a direction intersecting the circumferential direction of a notch formed on an outer periphery of the plate member.

5. The timepiece according to claim 1, wherein the wall portion is an inner peripheral surface of an opening formed in the plate member.

6. The timepiece according to claim 1, wherein the wall portion is a surface extending in a direction intersecting the circumferential direction of a notch formed on an outer periphery of the plate member.

7. A timepiece comprising:

a plate member;

an installation portion which rotatably supports the plate member about an axis in a plate thickness direction and is installed in an axial direction;

a pin which is erected in the installation portion in the axial direction;

an opening portion which is provided in the plate member, into which the pin is inserted, and which includes a width decreasing portion having a width decreasing toward one side of the axis in a circumferential direction; and a rotation mechanism which rotates the plate member to the other side in the circumferential direction to cause the pin to be clamped by the width decreasing portion, wherein the rotation mechanism includes an eccentric pin which is erected in the installation portion in the axial direction, and a wall portion which is provided in the plate member and with which an outer peripheral surface of the eccentric pin is capable of coming into contact, and wherein a rotation range of the eccentric pin includes a first rotation range spaced apart from the wall portion, and a second rotation range being in contact with the wall portion.

8. The timepiece according to claim 7, wherein the wall portion is an inner peripheral surface of an opening formed in the plate member.

9. The timepiece according to claim 7, wherein the wall portion is a surface extending in a direction intersecting the circumferential direction of a notch formed on an outer periphery of the plate member.

10. A timepiece comprising:

a plate member;

an installation portion which rotatably supports the plate member about an axis in a plate thickness direction and is installed in an axial direction;

a pin which is erected in the installation portion in the axial direction;

an opening portion which is provided in the plate member, into which the pin is inserted, and which includes a width decreasing portion having a width decreasing toward one side of the axis in a circumferential direction; and a rotation mechanism which rotates the plate member to the other side in the circumferential direction to cause the pin to be clamped by the width decreasing portion, wherein the rotation mechanism includes a mounting member which is mounted on an upper surface of the plate member and includes a taper pin having a diameter decreasing toward the installation portion, an engagement hole which is provided in the installation portion and with which the taper pin is engaged, and a wall portion which is provided in the plate member, and with which a peripheral surface of the taper pin on the other side in the circumferential direction comes into contact when the pin is inserted into the opening portion and the taper pin is inserted into the engagement hole.

11. The timepiece according to claim 10, wherein the wall portion is an inner peripheral surface of an opening formed in the plate member.

12. The timepiece according to claim 10, wherein the wall portion is a surface extending in a direction intersecting the circumferential direction of a notch formed on an outer periphery of the plate member.

* * * * *